United States Patent [19]

Hahn

[11] Patent Number: 5,001,861

[45] Date of Patent: Mar. 26, 1991

[54] AUTOMATIC UNIVERSAL DEADBOLT LOCKING DEVICE

[76] Inventor: Richard E. Hahn, 29931 Minglewood La., Farmington Hills, Mich. 48018

[21] Appl. No.: 394,974

[22] Filed: Aug. 17, 1989

[51] Int. Cl.[5] ..... E05F 15/00

[52] U.S. Cl. ..... 49/280; 248/300; 160/193

[58] Field of Search ..... 49/280, 360, 200, 199; 248/300; 160/188, 189, 193

[56] References Cited

U.S. PATENT DOCUMENTS

| | | | |
|---|---|---|---|
| 939,005 | 11/1909 | Goedeke | 248/300 |
| 1,431,662 | 10/1922 | Horning | 248/300 |
| 3,526,994 | 9/1970 | Delaney | 49/280 |
| 3,708,917 | 1/1973 | Streeter | 49/280 |
| 4,018,005 | 4/1977 | Harris | 49/199 |
| 4,300,958 | 5/1982 | Richmond | 49/280 |
| 4,344,252 | 8/1982 | Suzuki et al. | 49/199 |
| 4,443,972 | 4/1984 | Dolhaine | 49/199 |
| 4,597,224 | 7/1986 | Tucker | 49/280 X |
| 4,739,584 | 4/1988 | Zellman | 49/199 |
| 4,805,344 | 2/1989 | Hrboka | 49/280 |
| 4,819,379 | 4/1989 | Kenzelmann et al. | 49/280 |
| 4,827,667 | 5/1989 | Jarvis | 49/280 |

FOREIGN PATENT DOCUMENTS

| | | | |
|---|---|---|---|
| 1377503 | 12/1974 | United Kingdom | 49/199 |

*Primary Examiner*—Gary L. Smith
*Assistant Examiner*—Michael J. Milano
*Attorney, Agent, or Firm*—Reising, Ethington, Barnard, Perry & Milton

[57] ABSTRACT

A garage door locking device (10) includes a bracket (12) for connection to a garage door (12) and translating initial push/pull movement of a first push/pull cable (20) into locking and unlocking actuation of a latch member (30), respectively. The bracket (32) includes a slot defining a track having closed ends at each end thereof for stopping and engaging a follower member (44) mounted thereon. A second push/pull cable (48) has a first end connected to the follower member (44) and a second end connected to a latch member (30) so that the follower member (44) is biased towards one of the closed ends of the slot (40) when the latch member (30) is engaged to lock the door and the follower member (44) engages the other closed end of the slot (40) when the latch member (30) is disengaged from the locked condition.

6 Claims, 4 Drawing Sheets

AUTOMATIC UNIVERSAL DEADBOLT LOCKING DEVICE

TECHNICAL FIELD

The present invention relates to motor operated overhead garage doors of either the single panel type or multiple panel type. More specifically, the invention relates to a garage door locking device for securely locking a motor operated overhead garage door.

BACKGROUND ART

Motor operated overhead garage doors generally include a motor actuated first push pull cable for raising and lowering a garage door. The garage doors per se generally include a spring actuated latch member for being engaged within a fixed barrel to lock the garage door from unauthorized opening. However, these locking mechanisms must be unlatched for the automatic operation of the garage door.

Various prior art patents provide means for combining a motor operated overhead garage door mechanism with a locking device. For example, the U.S. Pat. No. 3,708,917 to Streeter, issued Jan. 9, 1973, discloses a motor operated overhead garage door including an operator connected to a belt crank lever pivotally mounted on the garage door so that the first movement of the operator swings the bell crank lever to retract a spring pressed locking device for locking the door in a closed position. Further movement of the operator lifts the door in a conventional manner. The U.S. Pat. Nos. 2,589,480 to Curtis, issued Mar. 18, 1952; 3,224,493 to Houk, issued Dec. 21, 1965; 4,254,582 to McGee, issued Mar. 10, 1981; 1,453,550 to Fogal, issued May 1, 1923; 2,703,235 to Reamey, issued Mar. 1, 1955; and 4,597,224 to Tucker, issued July 1, 1986, all relate to automatic garage door openers. None of the aforementioned garage door opening assemblies provide means which can be adapted to most garage doors. The present invention provides a garage door locking device which can be either original equipment or retrofitted to most existing assemblies by the simple addition of a bracket and push-/pull cable.

SUMMARY OF THE INVENTION

In accordance with the present invention, there is provided a garage door locking device of the type including a motor actuated first push/pull means for raising and lowering a garage door, the garage door including at least one spring actuated latch member for being engaged within a fixed barrel to lock the garage door from unauthorized opening. The device includes bracket means for connection to the garage door and translating initial push/pull movement of the first push-/pull means into locking and unlocking actuation of the latch member, respectively, the bracket means including a track and stop means at each end of the track for stopping and engaging a follower member mounted thereon. A follower member is mounted on the track for movement between the stop means and adapted for connection to the first push/pull means. At least one second push/pull means has a first end connected to the follower member and a second end including connecting means for connecting the second end to the latch member so that the follower member is biased towards one of the stop means when the latch member is engaged by the barrel and the follower member engages the other stop means when the latch member is disengaged from the barrel.

FIGURES IN THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
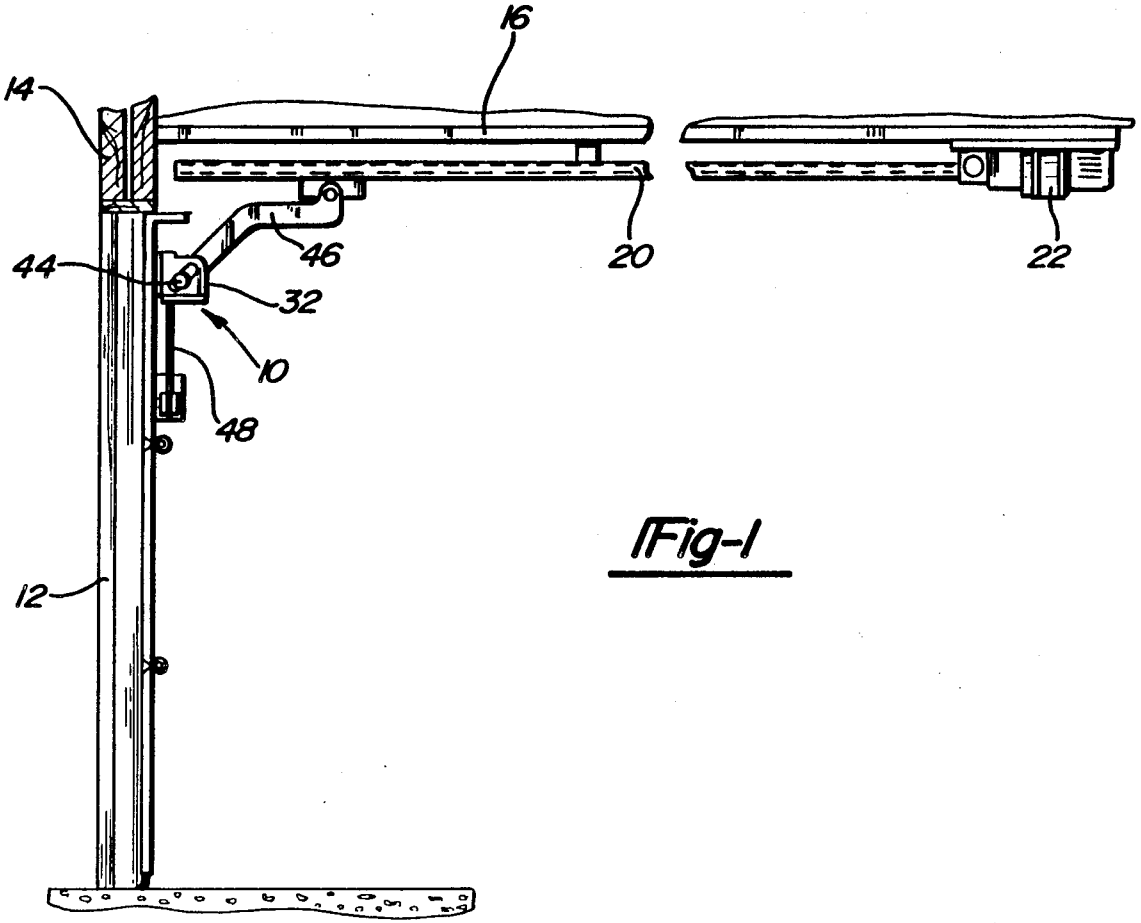
FIG. 1 is a side elevational view of the present invention mounted on a single panel type garage door.
Figure 2:
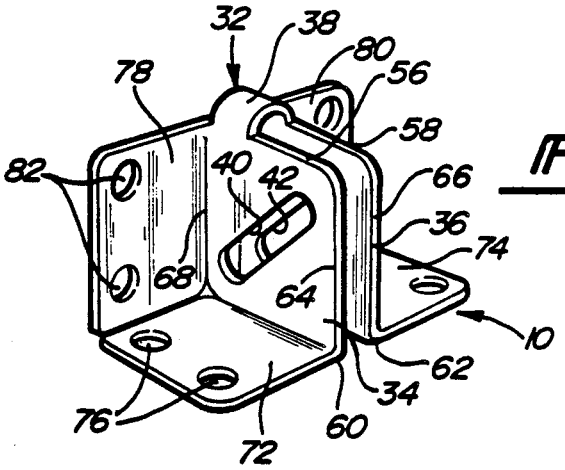
FIG. 2 is a perspective view of the bracket means constructed in accordance with the present invention.
Figure 5:
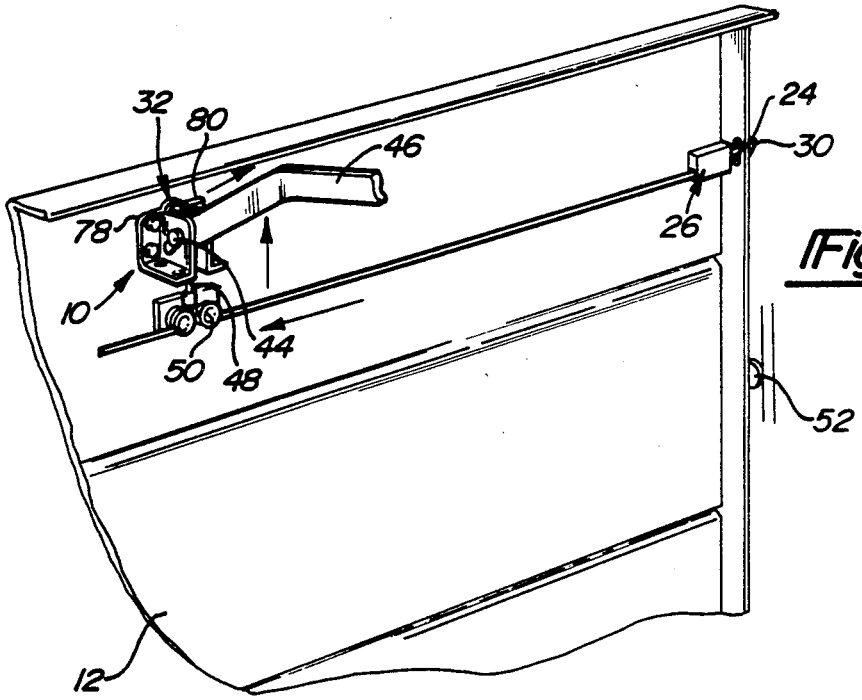
FIG. 5 is fragmentary perspective view of the present invention mounted on a multiple panel door.
Figure 6:
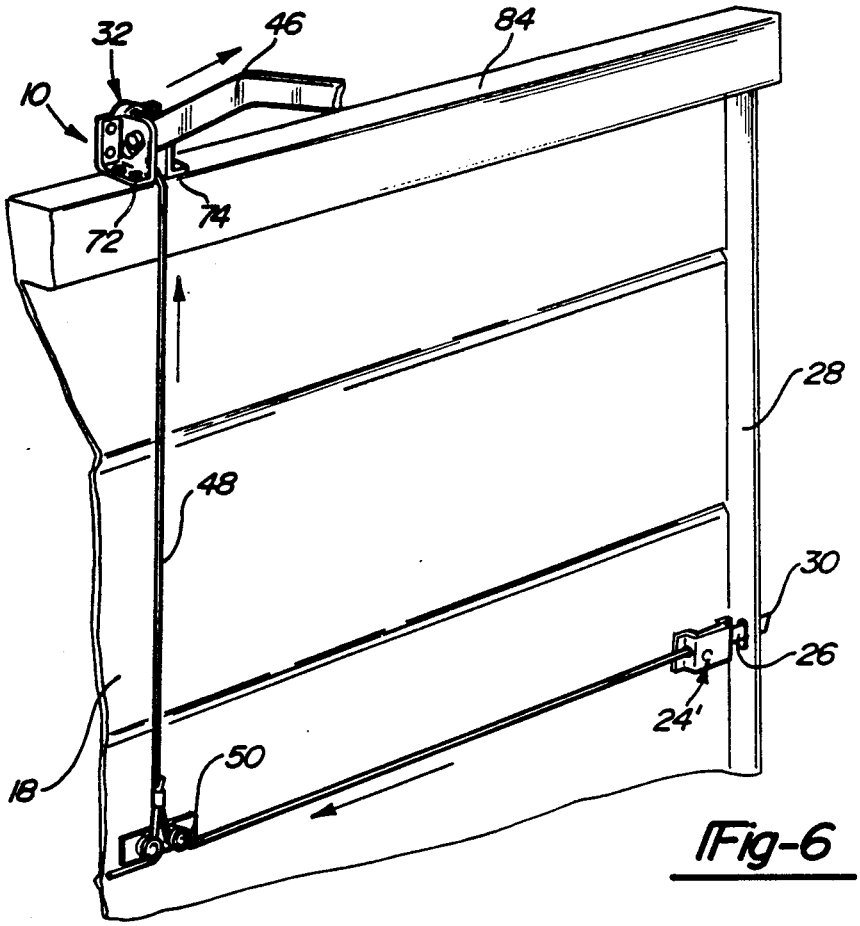
FIG. 6 is a fragmentary perspective view of the present invention mounted on a single panel door.

A garage door locking device made in accordance with the present invention is generally shown at 10 in the Figures. The device 10 in FIGS. 1 and 6 is shown on a single panel type garage door 12. The garage door 12 is mounted from a support structure 14 and ceiling 16 connected thereto. In FIG. 5, the device 10 is shown connected to a multiple panel type garage door 18.

The garage door locking device 10 is of the type including a first push/pull means, such as cable 20 actuated by a motor 22. The push/pull means of the invention can be in other forms, such as brackets, chains, ect. common in the art. Normally, the first push/pull cable 20 is for raising and lower the garage door 12. The garage door 12 includes at least one spring actuated latch mechanism generally indicated at 24 for being engaged within a fixed barrel defined by slot 26 in the garage door frame 28. The latch mechanism includes a spring biased latch member 30 for locking the garage door 12 from unauthorized opening.

Typically, the first push/pull cable 20 would be connected directly to the garage door for raising and lowering the garage door. The latch mechanism 24 would be operatively connected to a lever mechanism independent of the first push/pull cable 20 which raises and lowers the door for independently locking and unlocking the door from opening. The present invention provides an automatic locking mechanism which can be retrofitted onto such a garage door or can be original equipment.

The locking device 10 made in accordance with the present invention includes a bracket generally indicated at 32 for connection to the garage door 12 and for translating initial push/pull movement of the first push/pull cable 20 into locking and unlocking actuation of the latch member 30, respectively. More specifically, the bracket 32 includes two walls 34,36 interconnected by a bridge portion 38. Each of the walls 34,36 includes a slot 40,42. Each slot 40,42 defines a track having a stop at each end thereof for stopping and engaging a follower member 44 mounted thereon. The follower member 44 is mounted on the track for movement between each closed end thereof and adapted for connection to the first push/pull cable 20 through connecting member 46. Each slot 40,42 is at a 45° angle relative to the line defined by the first push pull cable 20.

Figure 3:
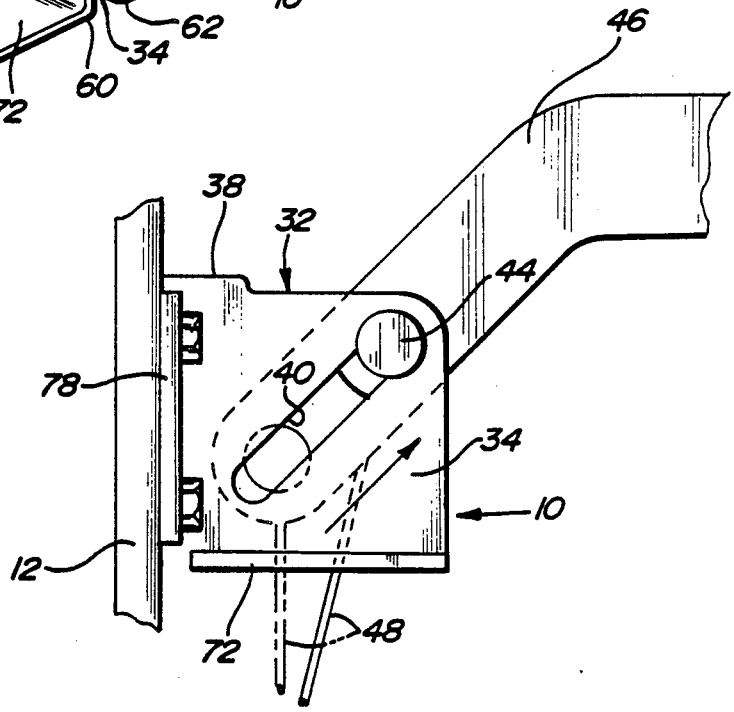
FIG. 3 is a side elevational view of the inventive bracket means showing the follower member between the locking and unlocking positions of the latch member.

At least one second push/pull means, such as cable 48 has a first end connected to the follower member 44 and a second end including means for connecting the second cable 48 to the latch member 30 so that the follower member 44 is biased towards one of the closed ends of the slot 40 as indicated in hatch lines in FIG. 3 when the latch member 30 is engaged in the slot 26 and the follower member engages the other closed end of the slot 40, as indicated in solid lines in FIG. 3 when the latch member 30 is disengaged from the slot 26. In other words, the bracket 32 provides a unitary member which is a lost motion support device for member 46 wherein follower member 44 which is integral with member 46 moves to the solid line position in FIG. 3 to unlock the latch 30 from slot 26 as the first cable 20 pulls on member 46. Further pulling by the cable 20 further forces member 46 against the closed end of the slot 40 to draw the door 12 to the open position. Once the latch member 30 is removed from the slot 26, it rides along railing 28 which has no further slots therein. The latch member is thereby retained in the open position. As the door is closed by the cable 20 moving in a reverse fashion, the follower member 44 is moved to the hatched line position in FIG. 3 thereby forcing the door downwardly. As the latch member moves downwardly with door, it reengages the slot 26 to lock the door when the door is in the closed position.

To properly entrain the second cable 48, the assembly can include a pulley mechanism 50 for properly routing the second cable 48. The second cable 48 may bifurcate as shown in FIGS. 5 and 6 to extend to a pair of latch members 30.

As shown in FIG. 5, the assembly can be adapted for use with a segmented or multi-panel type garage door. In this situation, the latch mechanism 24 can be mounted high on the door as the door 12 includes various rollers 52 carried in track which prevents the door from being force outwardly from the garage. Alternatively, the latch mechanism 24' for use with a single panel door is shown in FIG. 6. In this embodiment, the latch mechanism 24' is mounted lower on the door to prevent the door from being bent outwardly thereby allowing access to the garage.

Each of the walls 34,36 includes a top edge 56,58 and a bottom edge 60,62 and two side edges 64,66, 68,70 extending therebetween. The bracket 32 includes the bridge portion 38 which extends between the top edges 56,58 for interconnecting the walls 34,36.

A first pair of flanges 72,74 extend outwardly from the bottom edges 60,62 of each wall 34,36. Flanges 72,74 are coplanar and include mounting holes 76 therethrough. A second pair of coplanar flanges 78,80 extend from each one of the side edges 68,70 and away from each other. Flanges 78,80 include openings 82 therethrough. The openings 76,82 provide mounting means for universally mounting the bracket 32 on the garage door 12. For example, as shown in FIG. 5, the bracket 32 is mounted through openings 82 in flanges 78,80. As shown in FIG. 6, alternatively the bracket 32 may be mounted on the top portion 84 of the garage door 18 through openings 76 and flanges 72,74. Thusly, the flange configuration provides a universal mounting mechanism for the bracket 32.

Figure 4:
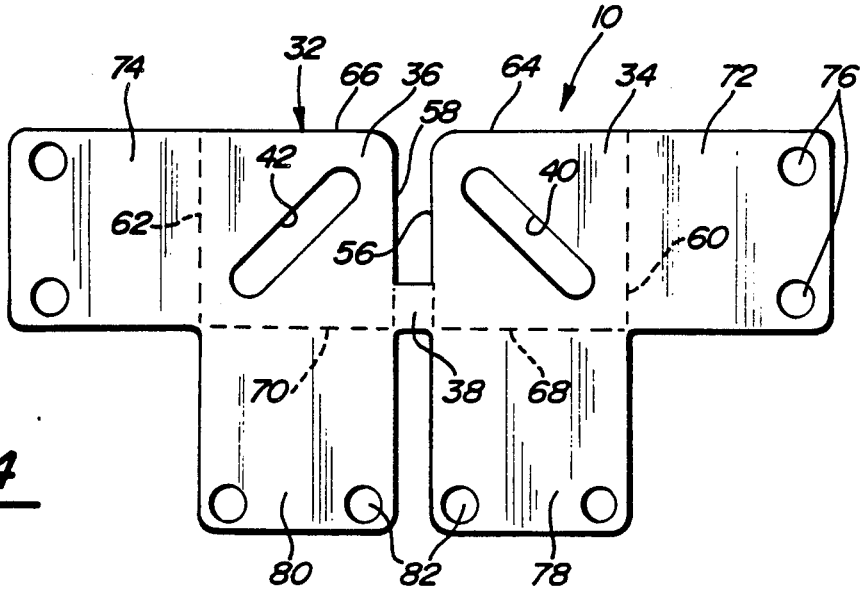
FIG. 4 is a plan view of the bracket means prior to forming.

The present invention provides a method of making the garage door locking device 10 including the general steps of forming the two walls 34,36 connected by the bridge portion 38 from a sheet of material, as shown in FIG. 4. The walls 34,36 each include the flange 72,74 extending from the bottom edges 60,62 thereof and outwardly extending flanges 78,80 extending from opposite side edges 68,70 thereof, the metric angled slots 40,42 are cut in walls 34,36. Mounting holes 76,82 are also cut through flanges 72,74,78,80. The walls 34,36 are bent towards each other 90° about the bridge portion 38 to be coplanar relative to each other. Flanges 74,76 are bent 90 relative to the bottom edges 60,62 away from each other to be coplanar relative to each other. The flanges 78,80 are bent along the side edges 68,70 90° away from each to be coplanar relative to each other.

The bracket 32 made in accordance with the present invention can be made from various bendible metals, such as aluminum or steel, pursuant to the subject method.

Figure 9:
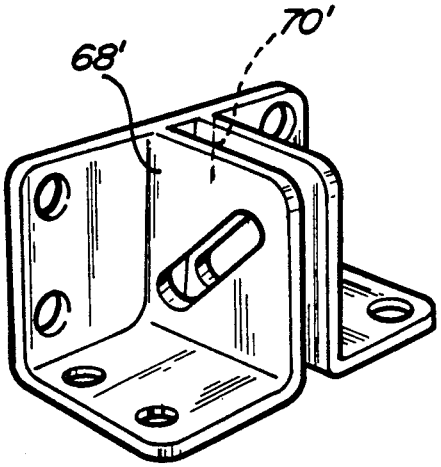
Figure 8:
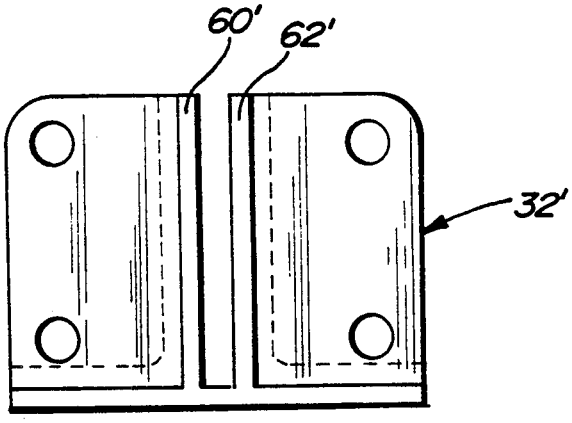
FIG. 8 is a front elevational view taken substantially along lines 8—8 of FIG. 7.
Figure 7:
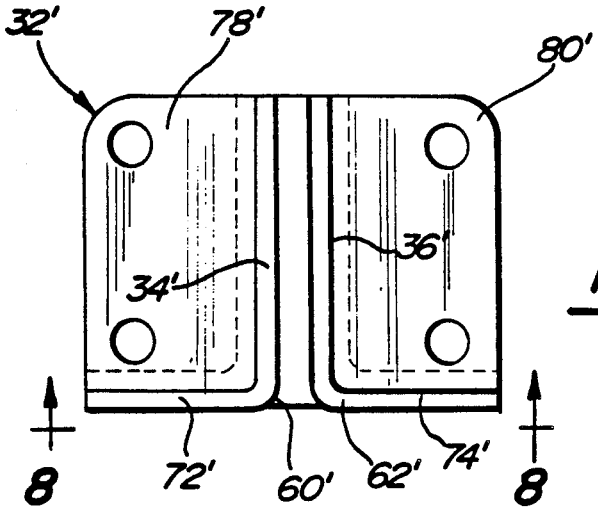
FIG. 7 is a front elevational view of second embodiment of the bracket means.

An alternative embodiment of the present invention is shown in FIGS. 7,8 and 9. Primed like numerals are used to indicate like structure between the two embodiments. This embodiment can be made from molded plastic capable of withstanding the forces exerted by the opening and closing action of the pin 44 along the slot 40' of the device. In this embodiment, each of the walls 34,36 include a bottom edge 60',62' and back edges 68',70'. The bracket 32' includes a rear panel integral with and interconnecting the back edges 68,70' of the walls 34',36'. The panel defines the flanges 78',80' and provides a solid portion 90 between the walls 34',36' thereby obviating the need of the bridge portion 38 of the first embodiment. Flanges 72',74' include mounting holes as discussed before with regard to the first embodiment and have rear edges integral with the flanges 78'80'.

An example of a plastic well suited for the present invention is Grivory G355 N2, made by Emser Industries, Surich, Switzerland. The plastic is an unreinforced, amorphus, high impact resistant, engineering thermoplastic.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A garage door locking device (10) of the type including a motor actuated first push/pull means (20) for raising and lowering a garage door (12), the garage door (12) including at least one spring actuated latch member for being engaged within a fixed barrel (26) to lock the garage door (12) from unauthorized opening, said device (10) comprising: bracket means (32) for connection to the garage door (12) and translating initial push/pull movement of the first push/pull means (20) into locking and unlocking actuation of the latch member (30), respectively, said bracket means (32) including a track and stop means at each end of said track for stopping and engaging a follower member (44) mounted thereon; a follower member (44) mounted on said track for movement between each of said stop means and adapted for connection to the first push/pull means (20); and at least one second push/pull means (48) having a first end connected to said follower member (44) and a second end including connecting means for connecting said second end to the latch member (30) so that said follower member (44) is biased towards one of said stop means when the latch member (30) is engaged by the barrel and said follower member (44) engages said other stop means when the latch member (30) is disengaged from the barrel (26), said bracket means including at least one slot (40) therethrough defining said track, said slot (40) angling upwardly away from the garage door (12) when mounted thereon, said slot (40) having two closed ends defining said stop means, said follower member (44) being seated in said slot (40) for movement between said two closed ends thereof, said bracket means (32) including two spaced parallel walls (34,36) for extending perpendicularly relative to the garage door (12) when mounted thereon each of said walls (34,36) including one of said slots (40,42) extending therethrough and being coextensive with said other slot (40,42) extending through the other of said walls (34,36), said follower member (44) comprising a pin extending through and seated within said slots (40,42); said pin (44) including a portion extending between said walls F(34,36) connected to said first push/pull and means second directly connected to said push/pull means (20,48).

2. A device as set forth in claim 1 wherein each of said walls (34,36) includes a top edge (56,58) and a bottom edge (60,62) and two side edges (64,66,68,70) extending therebetween, said bracket means (32) including a bridge portion (38) extending between said top edges (56,58) for interconnecting said walls (34,36), said bottom edge and at least one of said side edges including mounting means for universally mounting said bracket means (32) on the garage door (12).

3. A device as set forth in claim 2 wherein said mounting means includes a first pair of coplanar flanges (72,74) extending from each of said bottom edges (60,62) and away from each other and a second pair of coplanar flanges (78,80) extending from each one of said edges (68,70) and away from each other, each of said flanges (72,74,78,80) including openings therethrough for receiving mounting bolts therethrough.

4. A device as set forth in claim 1 wherein each of said walls includes a bottom edge (60',62') and a back edge (68',70'), said bracket means (32') including a rear panel integral with and interconnecting said back edges of said walls (34',36').

5. A device as set forth in claim 4 wherein said mounting means includes a first pair of flanges (72',74') extending from each of said bottom edges (60'62') and away from each other and said rear panel defining a second pair of flanges (78',80') extending away from said back edges (68',70') of said walls (34',36').

6. A bracket member (32) of the type for use with a garage door locking device including a motor actuated first push pull means (20) for raising and lowering a garage door (12), the garage door (12) including at least one spring actuated latch member for being engaged within a fixed barrel (26) to lock the garage door (12) for unauthorized opening, said bracket member (32) comprising: connecting means for connecting said bracket member (32) to the garage door (12); a track; stop means at each end of said track for stopping and engaging a follower member (44) mounted thereon, a follower member (44) mounted on said track for movement between each of said stop means and for being connected to the first push/pull means (20) and a second push/pull means (40) having a first end connected to said follower member (44) whereby initial push/pull movement of the first push/pull means (20) connected to the follower member (44) is translated into locking and unlocking of the latch member (30) through said second push/pull means (40), said bracket means including at least one slot (40) therethrough defining said track, said slot (40) angling upwardly away from the garage door (12) when mounted thereon, said slot (40) having two closed ends defining said stop means, said follower member (44) being seated in said slot (40) for movement between said two closed ends thereof, said bracket means (32) including two spaced parallel walls (34,36) for extending perpendicularly relative to the garage door (12) when mounted thereon each of said walls (34,36) including one of said slots (40,42) extending therethrough and being coextensive with said other slot (40,42) extending through the other of said walls (34,36) said follower member (44) comprising a pin extending through and seated within said slots (40,42), said pin (44) including a portion extending between said walls (34,36) connected to said first push/pull and directly connected to said second push/pull means (20,48).

* * * * *